US005606751A

United States Patent [19]

Baker

[11] Patent Number: 5,606,751

[45] Date of Patent: Mar. 4, 1997

[54] SHOWER CHAIR AND BATHTUB TRANSFER ASSEMBLY

[76] Inventor: Robert E. Baker, 4164 County Rd. 123, Bedford, Wyo. 83112

[21] Appl. No.: 591,999

[22] Filed: Jan. 26, 1996

[51] Int. Cl.[6] ..... A47K 3/02

[52] U.S. Cl. ..... 4/560.1; 4/578.1; 4/579

[58] Field of Search ..... 4/560.1, 562.1, 4/561.1, 563.1, 578.1, 579

[56] References Cited

U.S. PATENT DOCUMENTS

| | | | |
|---|---|---|---|
| 488,011 | 12/1892 | Keene | 4/579 |
| 1,075,829 | 10/1913 | Knipe . | |
| 1,813,950 | 7/1931 | Pribil . | |
| 2,624,644 | 1/1953 | Bryant . | |
| 2,648,849 | 8/1953 | Webb et al. | 4/560.1 |
| 3,381,317 | 5/1968 | Daniels et al. | 4/563.1 |
| 3,606,503 | 9/1971 | Asberg . | |
| 3,758,894 | 9/1973 | Finley . | |
| 4,091,479 | 5/1978 | Hancock . | |
| 4,253,203 | 3/1981 | Thomas . | |
| 4,359,791 | 11/1982 | Thomas . | |
| 4,429,925 | 2/1984 | Orain . | |
| 4,445,791 | 5/1984 | Klima . | |
| 4,475,256 | 10/1984 | Hatala . | |
| 5,002,404 | 3/1991 | Zernickel et al. . | |
| 5,026,177 | 6/1991 | Masuda . | |
| 5,033,873 | 7/1991 | Suzuki . | |
| 5,097,542 | 3/1992 | Roesler | 4/579 |
| 5,097,565 | 3/1992 | Shorey . | |
| 5,226,738 | 7/1993 | Valette et al. . | |
| 5,373,591 | 12/1994 | Myers . | |

FOREIGN PATENT DOCUMENTS

| | | | |
|---|---|---|---|
| 6339508A | 12/1994 | Japan | 4/561.1 |

*Primary Examiner*—David J. Walczak

*Attorney, Agent, or Firm*—Workman, Nydegger & Seeley

[57] ABSTRACT

A shower chair and bathtub transfer assembly having a unique mounting feature is presented that allows mounting of the assembly without extending any appreciable portion of the assembly outside of the bathtub space into the bathroom space. A bathtub transfer assembly frame rests upon the tops of the bathtub sides and has swing arms that fold downward and outward to run along the inner walls of the bathtub the swing arms having suction cup means to attach to the inner walls of the bathtub. A screw clamp means is placed in at least one of the swing arms to exert force between the swing arm and the bathtub inner wall with corresponding forces being placed either against the opposing bathtub inner wall or against the opposing bathroom wall to wedge the bathtub transfer assembly frame in a fixed position.

A chair runs laterally along the parallel members of the transfer assembly frame to position the chair at a desired location. Furthermore, the chair rotates to better position the chair for seating a person from outside the bathtub. A person is seated in the chair from outside the bathtub, then the chair is rotated and slid laterally until the person is positioned inside the bathtub for bathing or showering.

Finally, a bearing race is so formed between the chair section and transfer assembly frame section so that the two sections are held together by a plurality of bearings fed into the raceway through a bearing introduction channel.

18 Claims, 6 Drawing Sheets

SHOWER CHAIR AND BATHTUB TRANSFER ASSEMBLY

BACKGROUND OF THE INVENTION

1. The Field of the Invention

The field of this invention relates to tools, devices, and methods for assisting handicapped or persons of limited ambulatory ability with respect to bathroom facilities. More specifically, this invention relates to devices for assisting persons with limited ambulatory ability in entering a bathtub or shower stall in a conventional bathroom setting. Examples of such devices are chairs that slide on rails to help move non-ambulatory persons into a standard residential bathtub and transfer benches that allow a person to sit within the bathtub.

2. The Relevant Technology

Though the majority of the population enjoys full function of their limbs and hence normal ambulatory ability, there is a significant number of those amongst us who suffer impaired ambulatory ability. The causes for such ambulatory impairment are numerous including birth defects, accidental injuries, crippling, natural incidences of arthritis and other ailments common to the onset of old age, temporary injuries, etc. The range or degree of an ambulatory impairment varies from slight impairment that may be corrected by brace or cane to total impairment where a wheel chair or other means is constantly required for the person to move about. A mid-range ambulatory impairment would likely require a walker in order to assist a person so afflicted in moving around a familiar environment such as the home.

While progress has been made to ease the difficulties that face ambulatory impaired persons through legislation such as the Americans With Disabilities Act (ADA) and public building codes providing for handicap access to essential facilities, there exist numerous situations that require devices and methods that will assist ambulatory impaired persons in accomplishing daily tasks. A great variety of such devices exist to assist ambulatory impaired and other handicapped persons with routine activities.

One particularly important and common daily task is that of showering or bathing. The danger of mixing water with ambulatory impairment provides ripe opportunity for slipping and falling in a bathtub or shower. Furthermore, something as common as a tub wall that is easily stepped over or traversed by a fully ambulatory person becomes an immense obstacle and hurdle for the ambulatory impaired.

Currently, there exists a multitude of devices for assisting the ambulatory impaired in showering and bathing. Such devices are in many instances designed for the non-ambulatory person though, depending on the design, ambulatory impaired persons often may benefit as well. There are occasions, however, when the features of a given device designed to accommodate the non-ambulatory actually inhibit those persons whose ambulatory ability is only partially impaired.

One common and significant problem found in virtually all current devices is protrusion away from the side of the bathtub. In other words, the devices have a portion that extends beyond the outer wall of a common bathtub. This extension or protrusion may in some cases interfere with an ambulatory impaired persons' ability to move within the confined quarters of a typical residential bathroom. Furthermore, the protrusion may interfere with the use of other ambulator aids such as canes, walkers, or wheelchairs.

Naturally, these same concerns apply to someone who is assisting a non-ambulatory person from a wheelchair onto these devices and may be even more problematic since minimal bathroom space is already significantly overcrowded by having two persons and a wheelchair present.

One current device is a track and wheeled-chair combination. A parallel track is permanently or semi-permanently mounted onto a standard residential bathtub and a special wheelchair is designed so that the seat portion of the chair may slide with wheels or other rolling means from the chair frame onto the parallel tracks resting on the standard bathtub. In this way the non-ambulatory person may be brought to a position where the chair frame and the parallel tracks are aligned and then simply slid from the chair frame onto the parallel tracks and into a standard bathtub for showering or bathing. While such a device has many uses, it also has a number of drawbacks including, most notably, the use of a specialized wheelchair that may entail added expense. The parallel tracks would not work with a standard wheelchair but can only be used as part of a specialized chair and track combination. Furthermore, small bathrooms may not have enough room for a wheel chair to be turned parallel with the bathtub.

Other drawbacks include the extension of the parallel tracks away from the edge of the bathtub and the non-portable nature of the tracks that remain permanently or semipermanently affixed on the bathtub. This permanent or semi-permanent arrangement makes it difficult for fully ambulatory persons to use the bathtub in normal fashion as would be desirable where a bathroom is shared between fully ambulatory and ambulatory impaired persons. Again, the protrusion or extension of the parallel tracks away from the edge of the bathtub may cause accidental injury or inconvenience.

Another device combines a wheelchair with a folding parallel track that remains part of the wheelchair. The folding track has support legs and can be folded to a down position into the bathtub, the track being in a relatively horizontal position by way of the supporting legs. To use such a device, the non-ambulatory person is placed in the wheelchair, brought into the bathroom, and then the parallel track assembly is folded into the down position with the support legs, and hence the parallel track, in the bathtub. Next, the non-ambulatory person is then slid on the laterally moving seat from the main wheelchair frame along the parallel tracks until properly positioned in the bathtub for bathing or showering. Such a device is very cumbersome when used with a conventional wheelchair and is of no use to persons who are ambulatory impaired rather than non-ambulatory. As mentioned above, small bathrooms sometimes do not allow a standard wheelchair to be placed parallel with the bathtub.

Yet another device uses a track that is suspended from inside of the tub to outside of the tub by end assemblies, one in the tub, the other outside the tub. A pivoting or rotating chair will run along the track for moving the ambulatory impaired.

To operate this device, an ambulator impaired person is placed in the chair outside of the bathtub and then slid along the track to a position inside of the bathtub. Since the chair rotates or pivots, persons may be placed in the rotating chair from a number of positions thereby increasing the flexibility of this device. Because the nature of this device has a portion inside the tub and a portion well outside of the tub to suspend the track, there is significant encumbrance in the bathroom area that limits use of this device to dedicated purposes for assisting the ambulatory impaired. It would be fairly inconvenient to share a bathroom having such a device between ambulatory impaired and unimpaired persons.

Finally, most freestanding devices of this nature lack stability. Making sure a transfer device is stable becomes particularly important when heavier individuals are involved.

What is needed is a sliding chair and track type device that does not protrude away from the sides of a standard bathtub. Furthermore, a device is needed that is convenient, portable, and still allows easy access for use by both non-ambulatory persons as well as persons who are mobile but ambulatorily impaired.

A number of transfer benches also exist to assist persons in bathing or showering. Again, these transfer benches typically require extensions beyond the edge of a standard bathtub. One folding bench embodiment allows a caregiver to move a non-ambulatory person from a position outside the tub easily into a position inside the tub. The transfer bench essentially straddles the side of the bathtub allowing a person to be placed in a sliding chair outside the bathtub. Again, in order to function properly there is as much of the device outside the tub as inside the tub. The sliding chair takes a person from a position clearly outside the tub to a position inside the tub. The size of the transfer bench required to accomplish the above purpose takes a significant amount of bathroom space and creates uncomfortably cramped quarters.

Again, what is needed is a device that operates effectively to transfer a person from a point outside of a bathtub to a point inside of a bathtub without extending beyond the edge of the bathtub itself. Such a device would constitute a significant improvement in the art in that many advantages would be realized as enumerated hereafter.

SUMMARY AND OBJECTS OF THE INVENTION

It is an object of this invention to provide a device for assisting the ambulatory impaired to enter a standard residential bathtub in a safe and relatively convenient manner.

It is another object of this invention to provide a shower chair and bathtub transfer assembly wherein no part of the assembly extends appreciably beyond the outer sides or walls of the bathtub to provide desired benefits without interfering with bathroom space.

It is a further object of this invention to mount the shower chair and bathtub transfer assembly by exerting force between the inner walls of the bathtub, or alternatively, between the bathroom wall and the inner wall of the bathtub opposite the bathroom wall, to thereby wedge the shower chair and bathtub transfer assembly into a fixed and stable position with respect to the bathtub in such a manner that the ambulatory impaired will not be able to dislodge it during use.

It is an additional object of the present invention to provide a shower chair and bathtub transfer assembly that is adaptable to a variety of different residential bathroom and bathtub configurations.

It is another additional object of this invention to so construct a shower chair and bathtub transfer assembly in an inexpensive manner.

It is yet another object of the present invention to provide a shower seat that both pivots and moves laterally about parallel track surfaces so that the ambulatory impaired may easily be positioned or position themselves from a position outside of a bathtub to a position inside of a bathtub.

It is an object of the present invention to create a bearing race in a top section having a shower seat and a base section slidable along parallel tracks such that the base section and the top section are held together by the placement of bearings within the race.

It is another further object of the present invention to provide a shower chair and bathtub transfer assembly that is portable and can be readily tightened into position within a standard bathtub for stability and likewise be readily loosened from fixed position within a standard bathtub for easy transport.

It is an object of the present invention to provide a shower chair and bathtub transfer assembly that is adaptable for use by partially ambulatory persons as well as for non-ambulatory persons.

Additional objects and advantages of the invention will be set forth in the description which follows, and in part will be obvious from the description, or maybe learned by the practice of the invention. The objects and advantages of the invention maybe realized and obtained by means of the instruments and combinations particularly pointed out in the appended claims.

To achieve the foregoing objects, and in accordance with the invention as embodied and broadly described herein a shower chair and bathtub transfer assembly for assisting the ambulatory impaired is provided.

One embodiment of the shower chair and bathtub transfer assembly has two parallel tracks forming a transfer assembly frame with the tracks resting on the top of the tub sides. Interacting with the parallel tracks is a seat assembly that moves both laterally along the tracks as well as pivots or rotates with respect to the assembly frame.

Swing arms are mounted to the transfer assembly frame and allow a unique and beneficial method of mounting the portable shower chair and transfer assembly within a standard bathtub. While some current devices are mounted on freestanding support posts or pillars, such an arrangement has the drawback that at least one of the support posts is usually placed outside the bathtub itself. Even those that are mounted with clamping mechanisms typically require a portion of the mechanism to be located outside of the bathtub in order to clamp the entire side of a bathtub (i.e. both the inner and outer walls). Other devices that are more permanent require drilling or other potentially unalterable action.

The present invention, on the other hand, exerts force between the inner walls of a bathtub in order to wedge the transfer assembly frame in a fixed location. Alternatively, the transfer assembly can be wedged between the inner wall of the bathtub and the opposing bathroom wall. Typically, screw clamps are placed in at least one of the swing arms, near the top, to exert pressure from that swing arm outward against the inner wall of the bathtub. Suction means are located at the bottom of the swing arm to fix the swing arm alongside the bathtub inner wall.

Because the mounting is done internal to the bathtub (i.e. the pressure against the inner walls), there need not be an appreciable amount of the bathtub transfer assembly frame extend beyond the side of the bathtub. In other words, the plane foraged by extending the outer wall of the bathtub side upward need not be broken by any protrusion of the transfer assembly frame.

Movably engaged with the transfer assembly frame is a shower chair assembly that both pivots with respect to and moves laterally along the transfer assembly frame. Because of the lateral and pivoting movement, the chair assembly can be positioned such that a chair back lies in parallel with the tub side or perpendicular to the tub side. With the chair back parallel to the tub side and the chair assembly positioned forward towards the bathtub side edge, a person may be placed upon the chair easily or may place themselves upon the chair as they would any other chair. From this initial position, the chair assembly may be rotated and slid along the tracks so that the chair back now resides perpendicular to the tub side and rests midway between the tub sides thereby allowing a person to shower or bath themselves.

Fundamental to providing the pivot motion between the chair and the transfer assembly frame is a unique and beneficial bearing mechanism. A raceway for bearings is machined, molded, or otherwise formed in two constituent sections. One section will be slidably engaged with the transfer assembly frame and the other section will contain the chair seat and chair back. The raceway is so designed such that the sections are actually held together by a plurality of bearings fit into the raceway. In order to create this form of connection, a bearing loading channel is formed to allow the bearings to be introduced one at a time into the raceway until sufficient numbers of bearings exist to hold the two sections together after which a plug is placed into the bearing loading channel so that the bearings may be retained therein. The two sections are thereby retained in rotational contact and cannot be separated.

These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and objects of the invention are obtained, a more particular description of the invention briefly described above will be rendered by reference to a specific embodiment thereof which is illustrated in the appended drawings. Understanding that these drawing depict only a typical embodiment of the invention and are not therefore to be considered to be limiting of its scope, the invention will be described and explained with additional specificity and detail through the use of the accompanying drawings in which:

FIG. 4A shows the initial mounting of the shower and bathtub transfer assembly, FIG. 4B shows the model pivoting the chair assembly in order to traverse the bathtub side, and FIG. 4C shows the model in position between the bathtub sides and at a location where she may bathe herself.

DETAILED DESCRIPTION OF THE PREFERRED EMBODIMENTS

Figure 1:
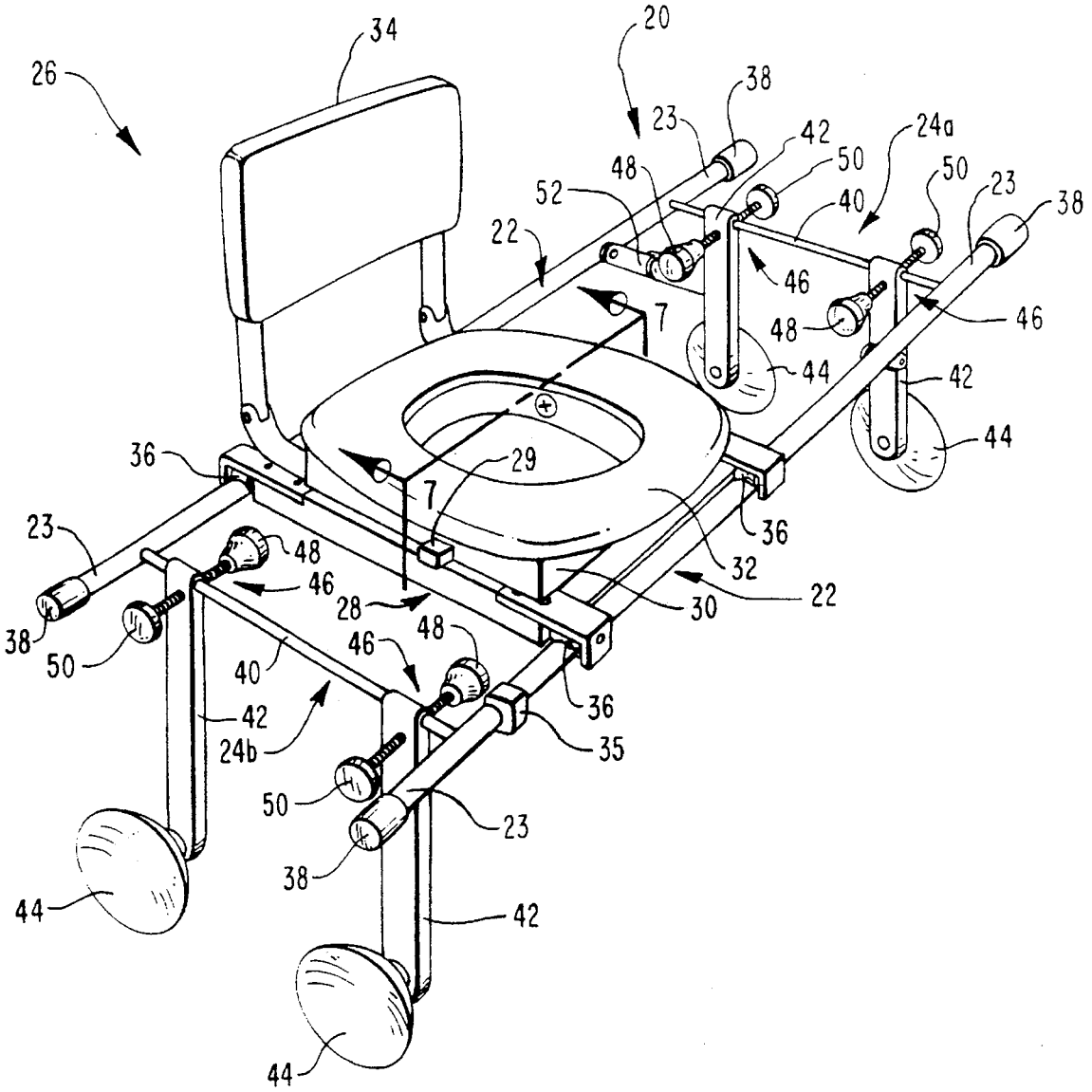
FIG. 1 shows a floating perspective drawing of a shower chair and bathtub transfer assembly and illustrates the component parts.

FIG. 1 shows a free-floating embodiment of the present invention in the form of a portable shower chair and bathtub transfer assembly that is useful for identifying the different pieces thereof. The transfer assembly frame 20 is composed of two tubular track members 22 that are oriented in parallel by swing arms 24*a*, 24*b*. The chair assembly 26 is composed of a bottom section 28 and a top section 30. Attached to the top section 30 is a chair seat 32 and a chair back 34. The bottom section 28 is slidably engaged with the tubular track members 22 of the transfer assembly frame 20 by rolling means 36. In this manner, the bottom section 28 may roll along the surface of the transfer assembly frame 20 from one end to the other.

It is important to note that the tubular track members 22 could be made into various shapes. They could be solid, integrated as part of a molded body, or a different shape other than round. The important factor is that there is a track surface for slidable engagement with the chair assembly rollers as explained hereafter or slidable engagement in some other manner.

Referring now to the transfer assembly frame 20, its important functional elements will now be discussed. Transfer assembly frame 20 has a number of main functions and many different configurations other than that illustrated in FIG. 1 may accomplish these functions. One function the transfer assembly frame 20 accomplishes is bearing the weight of a person using the portable shower chair and bathtub transfer assembly and dispersing this weight upon the sides of the bathtub. For purposes of this disclosure, a bathtub side is composed in its entirety of an inner wall, an outer wall, and top (see FIG. 2). As illustrated in FIG. 1, the two tubular track members 22 are designed to rest upon the top of opposing bathtub sides. The point of contact of the tubular members 22 will be the outer ends 23 thereby suspending the transfer assembly frame across the bathtub bathing area.

While the transfer assembly frame 20 is shown in FIG. 1 as being comprised of tubular track members 22 oriented in parallel, many other configurations as will be apparent to those skilled in the art could be used to accomplish the same purpose. For example, a molded plastic tray-like structure having lips to rest on top of each side of the tub could be utilized advantageously in harmony with the present invention.

Another purpose of the transfer assembly frame 20 is to provide a track surface for slidably engaging the chair assembly 26 in order to provide lateral movement of the chair assembly along the transfer assembly frame 20. While a single track surface may be sufficient in some embodiments, it is preferred to have two track surfaces oriented parallel as shown in FIG. 1 by the tubular track members 22 for added stability.

Finally, in some circumstances, another purpose of the transfer assembly frame 20 is to provide an abutment portion thereon for interacting with a bathroom wall. In FIG. 1, the tubular track member tips 38 can be used as an abutment portion of the transfer assembly frame 20 for wedging the assembly frame against a bathroom wall if necessary and as explained hereafter. Again, those skilled in the art will clearly recognize that other structures and forms may easily accomplish this abutment function without having the exact structure as illustrated in FIG. 1.

The track member tips 38 are made of a rubber, rubber-like substance, or any other friction enhancing material in order to provide positive gripping. This occurs against a bathroom wall when the track member tips 38 are used as an abutment portion of the transfer assembly frame 20 and tends to provide a sure contact surface between the transfer assembly frame 20 and the bathroom wall. Furthermore, the rubberized track member tips 38 will be resting on top of the bathtub sides and will provide added stability against movement during positioning of the transfer assembly frame 20 than would a metal to porcelain interface of the track member 22 with the top of the bathtub side.

Figure 3:
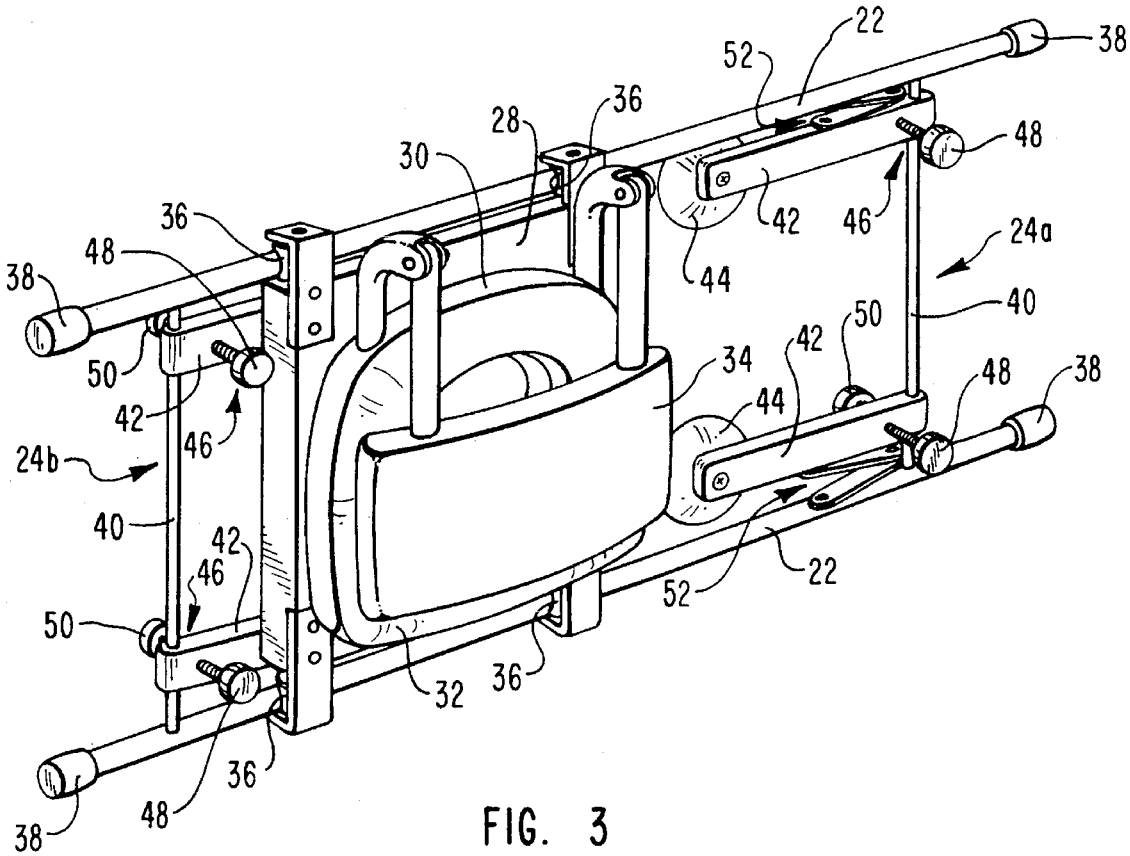
FIG. 3 shows the shower chair and bathtub transfer assembly of FIG. 1 in its folded condition to illustrate its portability.

Referring now to the swing arms 24*a*, 24*b* as shown in FIG. 1, more particular mention is made to the structure and function thereof. The swing arms 24*a*, 24*b* each comprise a pivotally mounted cross member 40 that pivots within the tubular track members 22. The pivotally mounted cross member 40 allows the swing arm 24*a* or 24*b* to move from a folded position for portability (as shown in FIG. 3) to an extended position for placement within a bathtub (as shown in FIG. 1). It is noteworthy that a variety of pivoting connections and configurations will be available to those skilled in the art and are contemplated within the scope of this invention without specific reference made to each individual type. For example, the cross member may be immovable with extension members 42 pivoting about the stationary cross member.

Attached to the pivotally mounted cross member 40 are two extension members 42. When the swing arms are in the extended position as shown in FIG. 1, the extension members 42 will run along the inner wall of the bathtub. Conversely, when the swing arms are in the closed position for portability (as shown in FIG. 3) the extension members 42 will lie parallel with the tubular track members 22 and the rest of the transfer assembly frame 20. While one extension member 42 is sufficient to complete the structure of the swing arms, two extension members 42 per swing arms 24*a*, 24*b* are preferred for stability purposes. Each of the two extension members 42 are located at opposing ends of pivotally mounted cross member 40 for each swing arm 24*a*, 24*b*.

At the distal end of each extension member 42 is a suction cup 44 that allows the shower chair and bathtub assembly to be attached to the inner wall of an ordinary bathtub. On the other end of the extension member, at a position near the pivotally mounted cross member 40, is a jackscrew means 46 for exerting pressure between the swing arms 24*a*, 24*b* and the inner wall of a bathtub. The extension members 42 of the swing arms 24*a*, 24*b* provide a base for allowing the jackscrews 46 to exert the above-mentioned pressure in order to wedge the shower chair and bathtub transfer assembly into a fixed position so that it may be used by an ambulatory impaired person. It may be noted that while the embodiment of FIG. 1 shows jackscrew means 46 on each of the four extension members 42, some embodiments may have jackscrew means 46 on as few as only one extension member 42.

The jackscrew means 46 is operated by twisting the jackscrew handle 48 so as to extend the jackscrew face 50 against the inner wall of a bathtub. As the jackscrew face 50 meets the inner wall of the bathtub continued operation of the jackscrew handle 48 will extend the extension member away from the bathtub inner wall and transfer this extension to the transfer assembly frame 20 through the pivotally mounted cross member 40. The suction cup 44 provides an anchor point to allow these forces to be transferred along the transfer assembly frame 20. Otherwise, the extension member 42 would simply move away from the inner wall of the bathtub because of the pivotally mounted cross member 40.

The suction cups 44 also hold the transfer assembly frame 20 at a desired position. The positioning function of the suction cups 44 allows use of the shower chair and bathtub transfer assembly without using the jackscrew means 46 for wedging the shower chair and bathtub transfer assembly between the inner walls of a bathtub or, alternatively, between an inner bathtub wall and the opposing bathroom wall in certain circumstances. The suction cups 44 will provide resistance against upward motion of the shower chair and bathtub transfer assembly as sometimes happens when lifting a person off the chair seat 32. Furthermore, suction cups 44 work best when a small amount of moisture is present on the inner wall of the bathtub in order to form a more powerful seal. Thus suction cups 44 provide a means of positioning the shower chair and bathtub transfer assembly and acts as an anchor point for operating the jackscrew means 46 to wedge the shower chair and bathtub transfer assembly in a common bathtub. A suction cup may also be placed on the end of the jackscrew means for added stability if desired.

Swing arm 24*a* shows the use of an optional locking hinge means 52 that changes the dynamics in operating the jackscrew means 46 when such locking hinge means 52 is present and in use. By using the locking hinge means 52 in the locked position as shown in FIG. 1, the swing arm 24*a*, including the extension member 42 connected thereon, becomes rigidly perpendicular with respect to the transfer assembly frame 20. In this rigidly perpendicular position, the forces caused by the operation of the jackscrew handle 48 causing the jackscrew face 50 to press against the inner wall of the bathtub will transfer through the locking hinge means 52 and pivotally mounted cross member 40 without the aid of the suction cup 44 to provide an anchor point. Those skilled in the art will clearly see that the swing arms 24*a* and 24*b* could be replaced with straight posts or hinged posts and still function within the spirit of the present invention.

Functionally speaking, any appendage from the transfer assembly frame 20 provides a base whereby forces can be exerted against the inner walls of the bathtub in order to wedge the shower chair and bathtub transfer assembly into a fixed and immovable position. Alternatively, the shower chair and bathtub transfer assembly could be wedged using a single appendage from the transfer assembly frame 20 to run along a bathtub inner wall and utilize an abutment portion of the transfer assembly frame 20 to fit against a bathroom wall opposite the bathtub inner wall having the downwardly extending appendage. Whether an appendage is rigidly perpendicular to the transfer assembly frame 20 or comprises some form of suction anchor point or has some other form of construction is immaterial as long as the appendage design provides a base for exerting force against the inner wall of a bathtub by jackscrew means or other means and allows the forces to be transferred from the appendage to the transfer assembly frame 20.

Referring now to the chair assembly 26 of FIG. 1, a top section 30 rotates about a base section 28 through bearing means (not shown). The bottom section 28 has rolling means 36 so that it may roll laterally along the surface of tubular track members 22 thereby providing lateral movement from the edge of the bathtub to the center of the bathtub. Lateral locking means 35 may be advantageously used, with the rolling means 36 or otherwise, to fix the base section 28 in a desired lateral position. For example, a desirable location to laterally fix the base section 28 may be at the edge of the bathtub to assist someone mounting the chair seat 32 or at a final position between the bathtub sides where a person would desire to begin showering.

Figure 7:
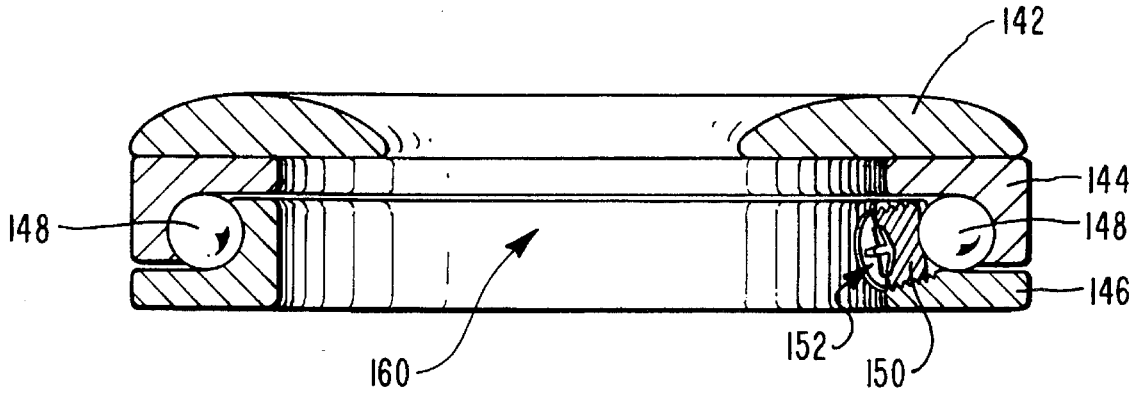
FIG. 7 shows a cutaway view of the top section and base section of the chair assembly taken along line 7 in FIG. 1.

The top section 30, as shown in FIG. 1, has attached thereto a chair seat 32 and a folding chair back 34. The folding attribute of chair back 34 allows for further portability (see FIG. 3). Rotational locking means 29 may be advantageously employed to lock the rotational movement of chair seat 32 with respect to the base section 28 at a desired location. For example, the top section 30, with chair seat 32, may be rotated such that the chair back 34 is parallel with the bathtub side and locked into position to allow a person easy and safe access onto the chair seat 32 for entering the tub. The top section 30 has attached, molded, or otherwise affixed therein part of a bearing race (not shown) that forms in part the means for achieving rotational movement. Conversely, the base section 28 has attached, molded, or otherwise affixed therein or molded thereon the mating section of the bearing race (not shown). The rotational engagement aspect of this invention, including bearing race, is shown in FIG. 7 and explained hereafter.

It may be noted that accessories to make the chair assembly 26 more user friendly may be advantageously added. For example, arm rests, whether folding or stationary, can be affixed to provide additional comfort and safety.

Figure 2:
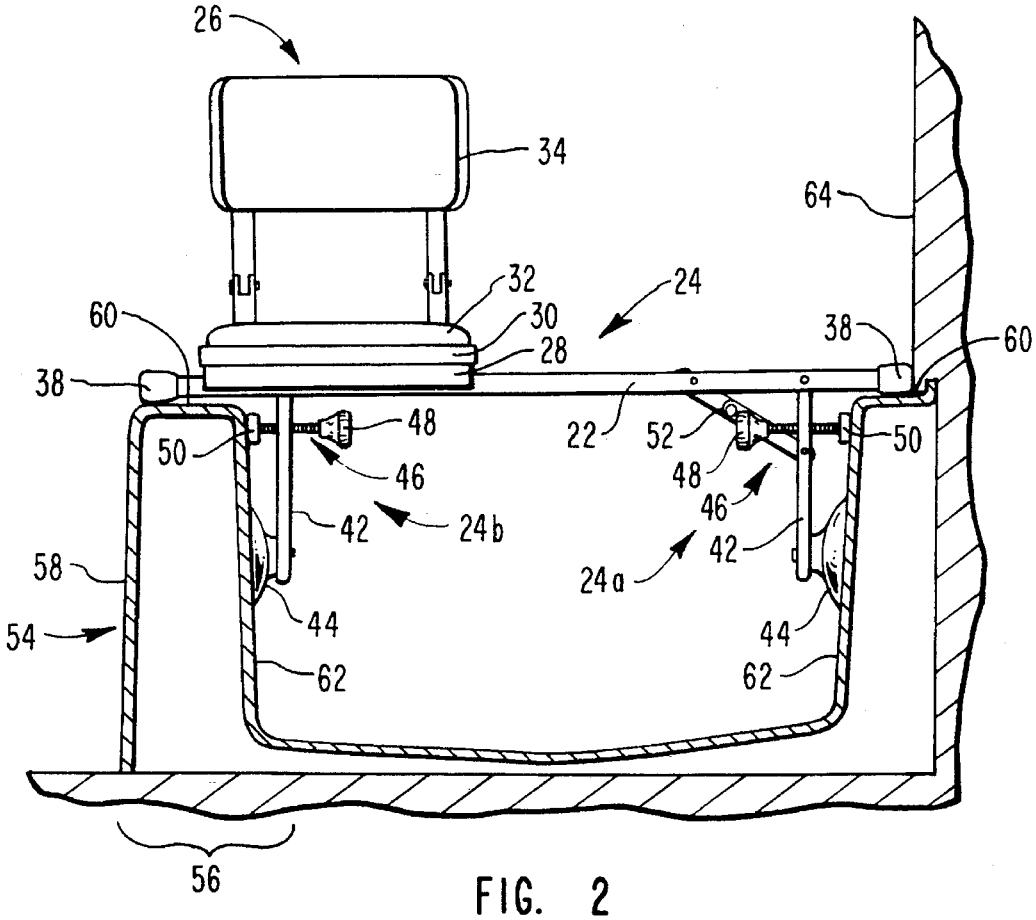
FIG. 2 shows the shower chair and bathtub transfer assembly of FIG. 1 mounted in a conventional bathtub with the bathtub shown in cutaway view and the shower chair and bathtub transfer assembly shown from a front edge view.

FIG. 2 shows the actual mounting of the portable shower chair and bathtub transfer assembly within an ordinary bathtub mounted against a bathroom wall. Bathtub 54 is a conventional bathtub having a rectangular tub area and is mounted against a bathroom wall 64. It may be noted that this invention is also adaptable for use with nonconventional bathtub shapes. Any modifications to adapt the present invention to nonstandard bathtub and bathroom arrangements should be considered obvious to those skilled in the art as long as the basic principles and concepts disclosed in this application continue to be present. Bathtub 54 has a bathtub side 56 composed of an outer wall 58, an inner wall 62 and a top 60. When referring to the edge of the bathtub 54 or bathtub side 56, reference is made to the general area of the juncture between the bathtub side top 60 and bathtub outer wall 58.

The shower chair and bathtub assembly is mounted within bathtub 54 and the chair assembly 26 is shown positioned toward the edge of the bathtub 54. While the suction cups 44 will provide an adequate amount of positioning force to stabilize the shower chair and bathtub transfer assembly for use, it becomes necessary in many cases and is preferred to more tightly fix or lock the position of the shower chair and bathtub transfer assembly with respect to the bathtub because of safety concerns. To lock or fix the position of the shower chair and bathtub transfer assembly, the transfer assembly frame 20 is tightly wedged between either the bathtub inner walls 62 or, alternatively, between a bathroom wall 64 and an opposing bathtub inner wall 62 as shown near swing arm **24*b***.

The mounting configuration as shown in FIG. 2 illustrates several different mounting and wedging possibilities, any one of which may be sufficient. One method is to wedge between the bathtub inner wall 62 associated with swing arm **24*b* and the bathroom wall 64. Another option is to wedge between the bathtub inner wall 62 associated with swing arm 24*b* and the opposing bathtub inner wall 62 associated with swing arm 24*a*. Additionally, there exist differences in operation of the jackscrew means 46 in transmitting forces to the transfer assembly frame 20 when using the suction cup 44 as an anchor point as in swing arm 24*b* as opposed to using a locking hinge means 52 to make the swing arm 24*a* rigidly perpendicular to the transfer assembly frame 20**.

In order to wedge the shower chair and bathtub transfer assembly between bathroom wall 64 and bathtub inner wall 62 near swing arm **24*b*, swing arm 24*a* could be entirely removed if desired since no attempt is made to wedge against the bathtub inner wall 62 associated with swing arm 24*a*. Suction cups 44 of swing arm 24*b* provide an anchor point for translational movement caused by operation of jackscrew means 46 associated with swing arm 24*b*. As the jackscrew handle 48 is manually twisted, the jackscrew face 50 presses against bathtub inner wall 62 and pushes swing arm 24*b* extension member 42 away from bathtub inner wall 62 and toward bathroom wall 64. This movement is transferred to the transfer assembly frame 20 and forces track member tip 38 against bathroom wall 64 until the entire shower chair and transfer assembly is wedged tightly into place. Suction cups 44 associated with swing arm 24*b* hold the extension members 42 against the inner wall 62 of the bathtub thereby forcing movement caused by jackscrew means 46 to wedge the transfer assembly 20 against the bathroom wall 64**.

If using swing arm **24*a* to wedge against the bathtub inner wall 62 associated with swing arm 24*a*, suction cups 44 associated with swing arms 24*a* and 24*b* need not be present in swing arm 24*a*. This is possible on swing arm 24*a* because of locking hinge means 52 that makes swing arm 24*a* rigidly perpendicular to the transfer assembly frame 20. Furthermore, jackscrew means 46 need not be present in swing arm 24*a* because of the rigidly perpendicular quality of swing arm 24*a*. As the jackscrew means 46 associated with swing arm 24*b* is manually operated, the swing arm extension members 42 are driven away from the bathtub inner wall 62. This movement is transferred into the transfer assembly frame 20 to drive the rigidly perpendicular swing arm 24*a* toward bathtub inner wall 62**.

Suction cups 44 on extension members 42 associated with rigidly perpendicular swing arm **24*a* are used to provide a place of attachment and inner action with bathtub wall 62 rather than an anchor point. Also, jackscrew means 46 associated with swing arm 24*a* can be used to adjust and provide a countervailing force to tightly wedge the shower chair and bathtub assembly between the inner walls 62 of bathtub 54**.

In embodiments where locking hinge means 52 is not present, suction cups 44 attached to extension members 42 of swing arm **24*a* will serve as an anchor point for jackscrew means 46 associated with swing arm 24*a*. In such embodiments without the locking hinge means 52 or other means to make swing arm 24*a* rigidly perpendicular, the jackscrew means 46 of swing arm 24*a* or other means of abutment will be necessary in order to wedge the shower chair and bathtub transfer assembly between the inner walls 62 of bathtub 54. Without the jackscrew means 46 on swing arm 24***a* and assuming a freestanding tub not against a bathroom wall, transfer assembly frame 20 would simply move laterally until either the jackscrew means 46 of swing arm 24*b* had reached full extension or suction cups 44 associated with swing arm 24*a* had become removed from bathtub inner wall 62. In either case, it is very likely that the shower chair and bathtub transfer assembly would not be properly wedged between the inner walls 62 of bathtub 54.

In some alternative embodiments, the suction cups or other suction means attaching swing arms 24*a* and 24*b* (or other appendages) may be designed to provide sufficient anchoring of the transfer assembly frame that tightening means are not needed. This would be most beneficial for traveling applications where quick set up is important. In such an embodiment, the suction cups would hold shower chair and transfer assembly within the bathtub and keep it from moving any substantial distances laterally.

FIG. 3 illustrates the complete portability of the shower chair and bathtub transfer assembly. The swing arms 24*a*, 24*b* are moved into their folded position by rotating about pivotally mounted cross member 40. In the folded position, swing arms 24*a*, 24*b* are oriented such that extension members 42 lie substantially flat and parallel to tubular track numbers 22. Furthermore, hinged chair back 34 is folded from the up position to the down position to lie flat against chair seat 32, thereby making the shower chair and transfer assembly substantially flat and easy to transport and carry. Additionally, the components of the shower chair and bathtub transfer assembly are made of strong but lightweight metal so as to be easily hefted by those needing to transport the shower chair and bathtub transfer assembly yet have appropriate strength to be wedged into a fixed position and support the weight of non-ambulatory persons. It may be noted that many forms of plastic and other strong, lighter weight materials may be utilized in the construction of a shower chair and bathtub transfer assembly according to the present invention.

Figure 4A:
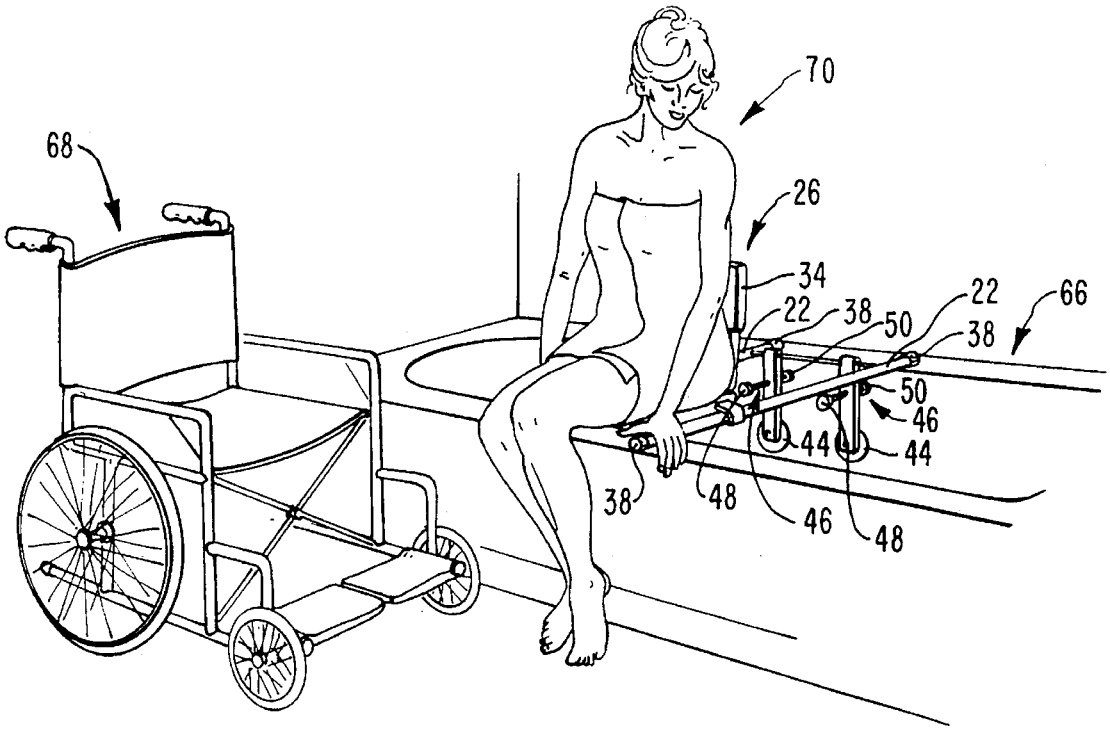
FIGS. 4A–4C show an ambulatorily impaired model using the shower chair and bathtub transfer assembly of FIG. 1 to position herself from outside of the bathtub to inside the bathtub.
Figure 4B:
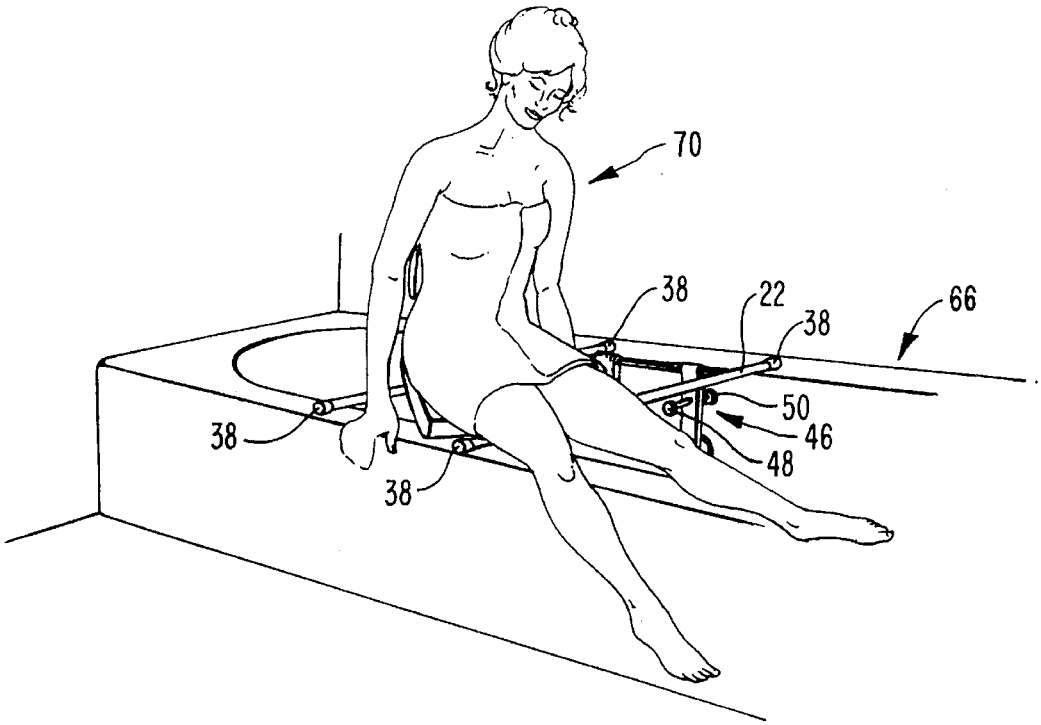
Figure 4C:
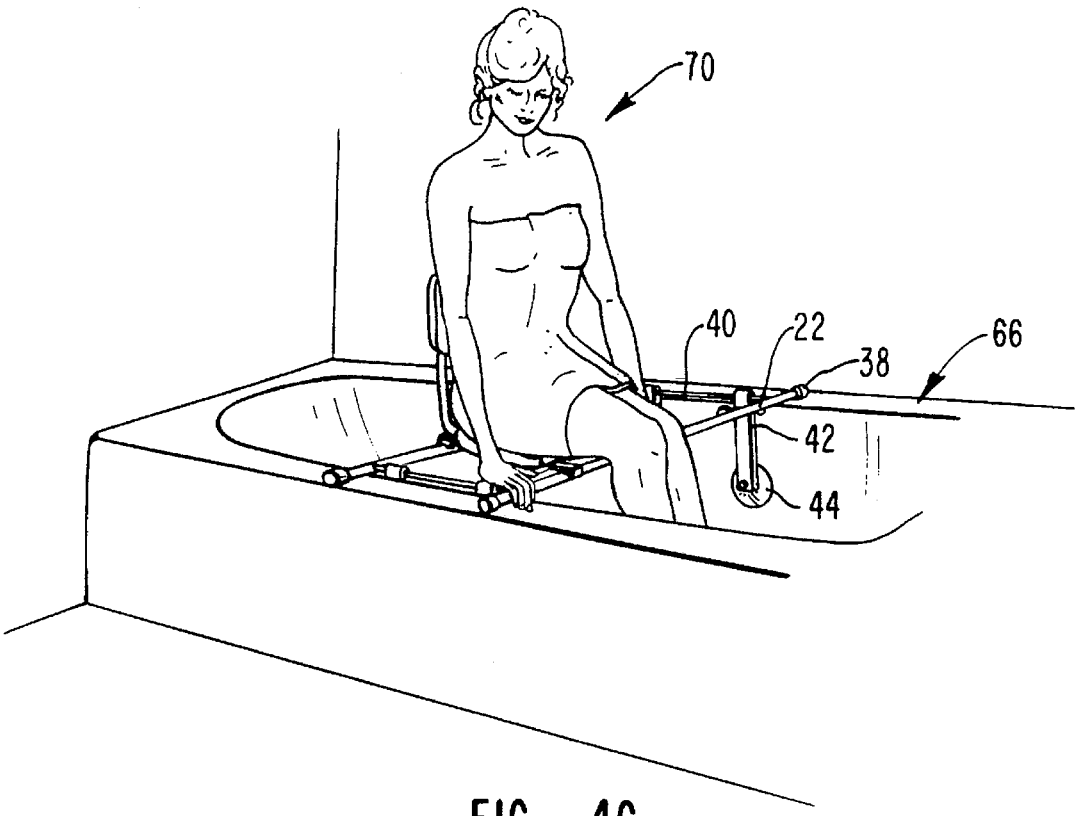

FIGS. 4A–4C show use of the shower chair and bathtub transfer assembly to bring a person from a position outside of the bathtub to a position inside the bathtub. FIG. 4A shows the ambulatorily impaired model 70 as she is sitting upon seat 32 of chair assembly 26 after leaving wheelchair 68. At this initial point, the chair assembly 26 has been slid laterally to the edge of bathtub 66 with the seat back 34 parallel to the bathtub side and the model 70 is outside the bathtub. FIG. 4B shows the ambulatorily impaired model 70 as she pivots the chair assembly, placing her body lengthwise with the bathtub in order to traverse the bathtub side. FIG. 4C shows the model 70 after she has centered the chair assembly between the bathtub sides to a position completely inside the bathtub where she may begin bathing or showering.

Figure 5:
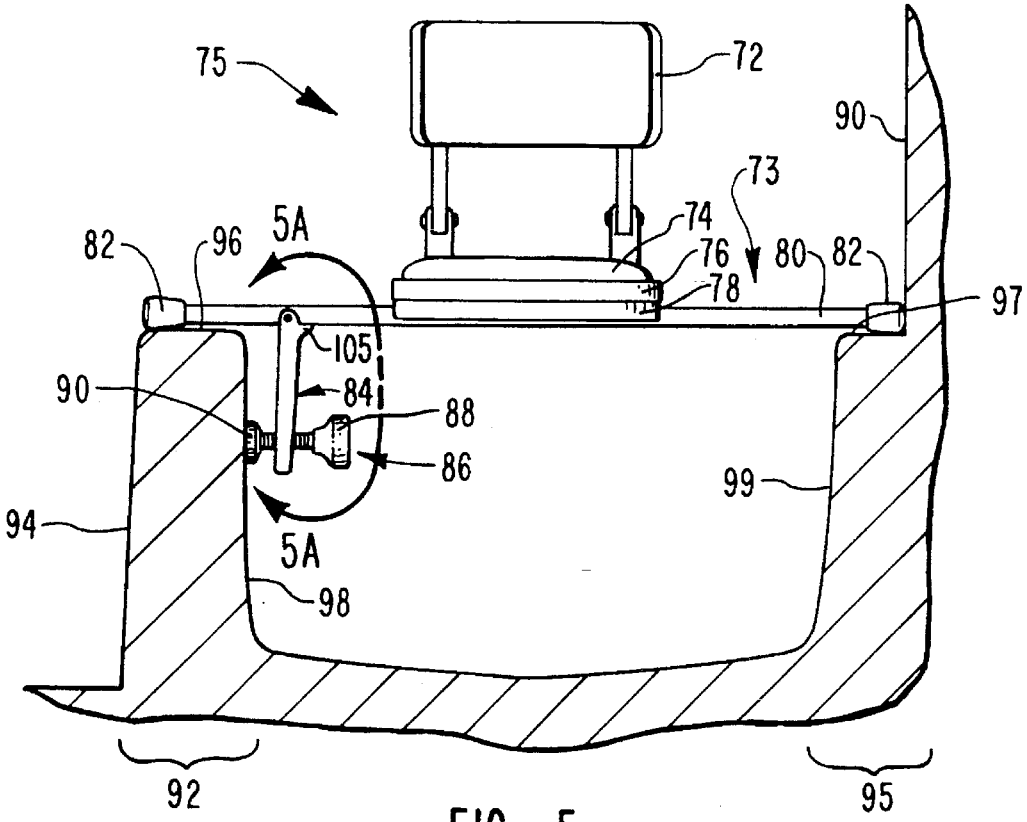
FIG. 5 shows another embodiment of the shower chair and bathtub transfer assembly having folding posts with jackscrew means for wedging the shower chair and bathtub transfer assembly between an inner bathtub wall and opposing bathroom wall.

FIG. 5 illustrates another embodiment of the shower chair and bathtub transfer assembly that retains much of the construction of the previous embodiment with the exception of having a folding post mechanism rather than swing arms. A chair assembly 75 rests upon a transfer assembly frame 73 that is composed of a pair of parallely spaced tubular track members 80. The chair assembly 75 comprises a folding chair back 72 and chair seat 74 mounted on top of a top section 76. The base section 78 laterally interacts along the parallel tubular track members 80 through rolling means (not shown) and is rotationally connected to top section 76 by bearing means (not shown). The track members 80 making up the transfer assembly frame 73 rest upon the top 96 of bathtub side 92 and the top 97 of bathtub side 95 adjacent to wall 90. The track member tips 82 are rubberized to provide positive gripping.

At least one of the parallel track members 80 has a folding post 84 oriented along a parallel track member 80 near bathtub side 92 inner wall 98 opposite from bathroom wall 90. When the folding post is folded down as shown in FIG. 5, and pressure is exerted through jackscrew means 86 the folding post 84 becomes rigidly perpendicular to the tubular track member 80 by means of a folding post brace 105 (more detailed explanation in FIG. 5A). When jackscrew handle 88 is manually operated, pressure is exerted against bathtub inner wall 98 by jackscrew face 90 and these forces are carded through rigidly perpendicular folding post 84 to the transfer assembly frame 73 tending to push the transfer assembly frame 73 against bathroom wall 90. In this manner, the transfer assembly frame 73 may be wedged between bathtub inner wall 98 and opposing bathroom wall 90 by jackscrew surface 90 and the tubular track member tip 82.

With this embodiment, no mechanism is necessary to interact with bathtub side 95 inner wall 99 and the benefit of not extending beyond bathtub side 92 outer wall 94 is retained. Furthermore, the folding post 84 is simple and inexpensive to manufacture. While only one folding post 84 is necessary to wedge the transfer assembly frame 73, it is preferred to have two folding posts 84, one for each track member 80, with at least one and preferably both folding posts 84 having a jackscrew means 86. A jackscrew means may also be implemented independently of the folding posts by use of other arrangements. It is noteworthy that the shower chair and bathtub transfer assembly can be wedged using the bathtub side 95 inner wall 99 instead of or in addition to the bathroom wall 90 with the addition of folding posts or other downward extending appendages to the transfer assembly from 73 to engage the bathtub side 95 inner wall 99.

Figure 5A:
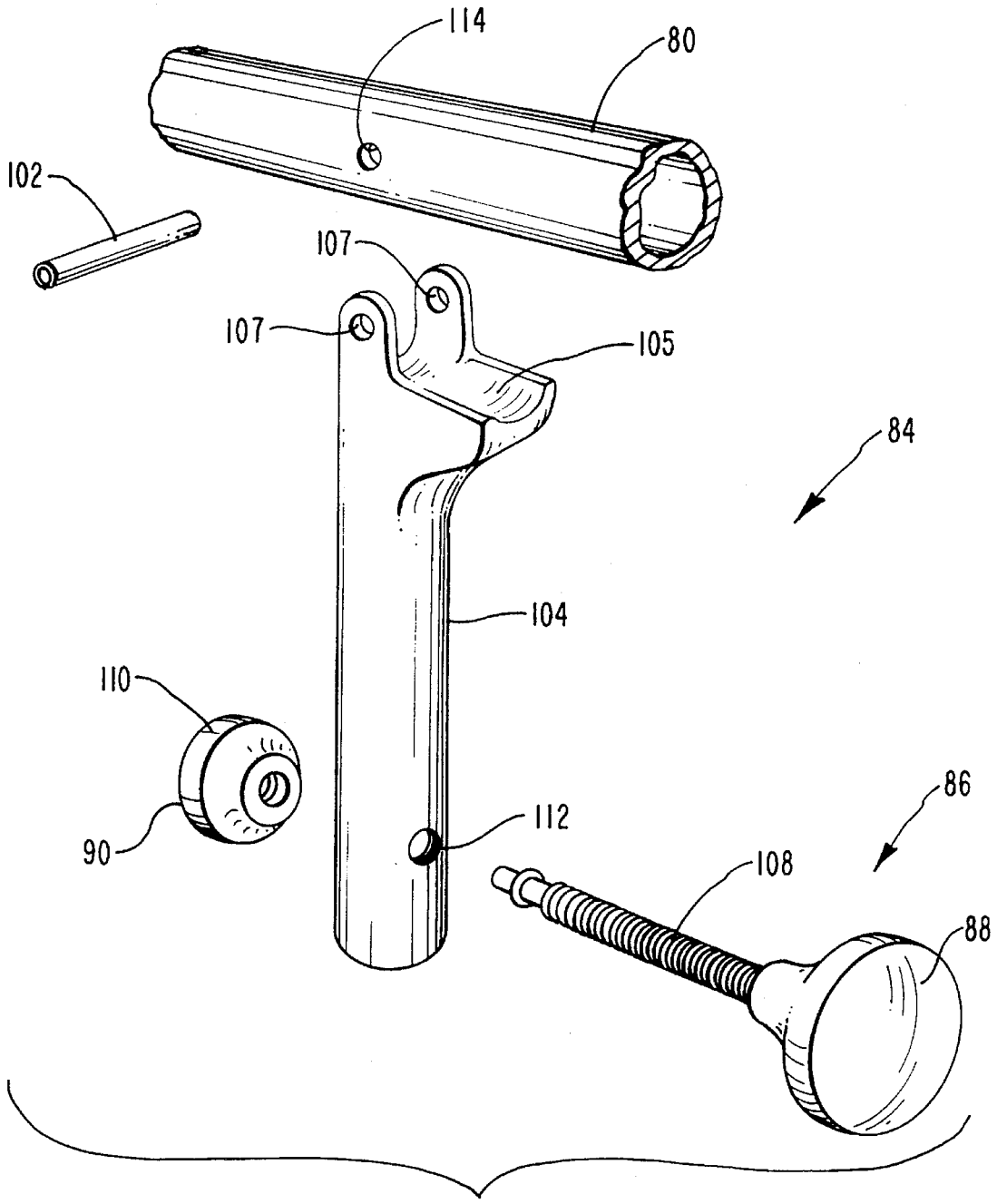
FIG. 5A is an exploded view of an individual folding post of FIG. 5 showing the post construction and constituent parts.

FIG. 5A shows an exploded detail drawing of the folding post 84 found in FIG. 5. The folding post 84 is comprised of a folding post body 104 having a folding post brace 105. The tubular track member 80 has a retention hole 114 for receiving pivot pin 102. The folding post body 104 has corresponding pivot holes 107 that are aligned with the retaining hole 114 and are maintained in alignment by the pivot pin 102. In the folded up position, the folding post body 104 will reside substantially parallel and flat against the tubular track member 80. When in the folded down or extended position, the folding post body 104 will be positioned perpendicular to tubular track member 80 and is considered a downward extending appendage thereof. Furthermore the folding post brace 105 will interact with tubular track member 80 when the folding post body 104 is in the down position so as to prevent further movement beyond the perpendicular orientation with respect to tubular member 80. It is this folding post brace 105 that allows forces to be exerted through the folding post body 104 and up into the tubular track member 80 by the jackscrew means 86.

The jackscrew means comprises a threaded jackscrew shaft 108 attached to a jackscrew handle 88 and introduced into a threaded bore 112 of the folding post body 104. A jackscrew face piece 110 is connected to the end of the threaded jackscrew shaft 108 and provides the jackscrew face 90 to interact with a bathtub inner wall 98.

As the jackscrew handle 88 is manually operated, the jackscrew face 90 presses against an inner tub wall 98 exerting a force to the folding post body 104. Because of folding post brace 105, the folding post body 104 will not move and the force will be transmitted along the track member 80. It is also worth noting that rigid posts may be used instead of folding posts without departing from the spirit of the present invention.

Figure 6:
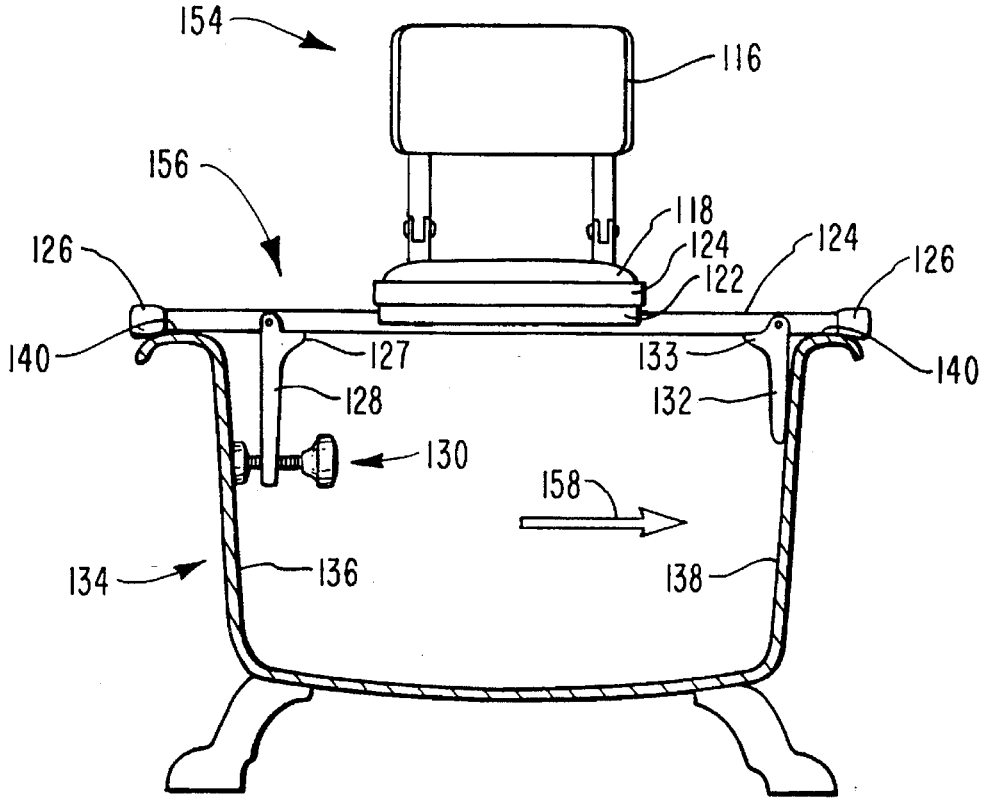
FIG. 6 shows yet another embodiment of the shower chair and bathtub transfer assembly having folding posts on each side of the transfer assembly frame for mounting the assembly between two inner tub walls of a freestanding bathtub with the bathtub shown in cutaway view.

FIG. 6 shows another embodiment of the present invention that is adaptable for use with a freestanding bathtub 134. Again, the upper portion of the shower chair and bathtub transfer assembly are substantially the same as in previous embodiments. A transfer assembly frame 156 is comprised of two tubular track members 124 oriented in parallel with each tubular track member 124 having rubberized tips 126 for positive gripping. The tubular track members 124 are held apart in parallel by cross member structure (not shown).

A chair assembly 154 rides on the surface of tubular track members 124 through rolling means (not shown) found in base section 122. A top section 120 is rotationally engaged with the bottom section 122 and further has a chair seat 118 and folding chairback 116.

Freestanding bathtub 134 has inner walls 136 and 138 and bathtub lips 140 to support the transfer assembly frame 156. In this embodiment, opposing folding posts 128 and 132 provide the downward extending appendages from transfer assembly frame 156 that allow the transfer assembly frame 156 to be wedged between freestanding bathtub 134 inner walls 136 and 138.

Folding post 132 has a folding post brace 133 oriented so that when force is applied to the transfer assembly frame 156 in the direction of arrow 158, the folding post 132 remains rigidly perpendicular to the parallel track member 124 and will transmit forces exerted along parallel track member 124 in the direction of arrow 158 to the freestanding bathtub 134 inner wall 138. While only one folding post 132 connected to one of two parallel members 124 is necessary to provide a downwardly extending appendage from the transfer assembly frame 156 for wedging, it is preferred that each tubular track member 124 of transfer assembly frame 156 have a folding post 132 to engage freestanding bathtub 134 inner wall 138 for stability purposes.

To engage the other inner wall 136 of freestanding bathtub 134, at least one folding post 128 is necessary. Again two folding posts 128, one each being associated with each tubular track member 124 of transfer assembly frame 156 and positioned near inner wall 136, is preferred for added stability. Folding post brace 127 will keep folding post 128 rigidly perpendicular with respect to the transfer assembly frame 156 and transfer forces along the transfer assembly frame 156 when forces are in the direction of arrow 158.

FIG. 6 shows folding post 128 having a jackscrew means 130 to generate forces in the direction of 158. When this is done, the transfer assembly frame 156, and hence the entire shower chair and bathtub transfer assembly, becomes wedged between the freestanding bathtub 134 inner walls 136 and 138. It is noteworthy that only one jackscrew means 130 need be present on a folding post 128, or though it may be preferable to assure that each folding post 128, if two are present, has a jackscrew means 130. Furthermore, a jackscrew means such as 130 may be placed in folding post 132 as opposed to folding post 128 and accomplish the same results. The folding post braces 127 and 133 are so oriented that it is unimportant whether the forces are in the direction of arrow 158 or completely opposite therefrom in order to wedge the transfer assembly frame 156 firmly between the freestanding bathtub 134 inner walls 136 and 138.

FIG. 7 shows the rotational engagement caused by a plurality of bearings in a bearing race between a base section 146 and a top section 144, the top section 144 having the chair seat 142. The top section 144 and the base section 146 are so machined, molded, or otherwise constructed that when fit together as shown in FIG. 7 they form a bearing race 160 for a plurality of bearings 148. The bearing race 160 is also so formed that without the plurality of bearings 148 introduced therein, the base section 146 and the top section 144 may be easily separated. When bearings are introduced through the beating loading channel 152 and the plurality of bearings 148 fills the bearing race 160, the base section 146 and the top section 144 cannot be separated being held together by the plurality of bearings.

In order to retain the plurality of bearings 148 within the bearing race 160, a threaded closing plug 150 is introduced into corresponding threads of loading channel 152. The plurality of bearings 148 provide both a means of connecting the base section 146 with the top section 144 and a means whereby the top section 144 may smoothly and easily rotate with respect to base section 146. It is noted that the rotational engagement scheme described in FIG. 7 corresponds to all disclosed embodiments and stands as one example of the rotational engagement. Naturally, those skilled in the art will recognize a variety of other possibilities for accomplishing the same described functions of allowing rotational movement between base section 146 and top section 144 while also engaging the two respective sections to keep them from becoming separated.

Because the shower chair and bathtub transfer assembly of this invention is designed to be used in the presence of moisture as well as soap and other cleaning materials, plastics or other non-corrosive or corrosion resistance materials are preferred in the construction of the bearing race and, in particular, the plurality of bearings 148. The bearing design was based on the crush strength of the plastic balls used in the plurality of bearings 48 rather than the shear strength that is often used in bearing design.

The present invention may be embodied in other specific forms without departing from its spirit or essential characteristics. The described embodiments are to be considered in all respects only as illustrated and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. A portable shower chair and bathtub transfer assembly for fitting into a standard bathtub having inner walls and outer walls and the bathtub mounted against a bathroom wall, the portable shower chair and bathtub transfer assembly comprising:

a transfer assembly frame comprising at least one track surface extending along a substantially horizontal plane position parallel to an upper surface of said outer walls and an abutment portion, the abutment portion adapted to rest against the bathroom wall, and the transfer assembly frame adapted to rest on top of the bathtub walls;

at least one appendage attached to the transfer assembly frame, the appendage adapted to extend downwardly along the bathtub inner wall opposite the bathroom wall; and a chair assembly comprising a base section, the base section slidably engaged along the at least one track surface to allow substantially horizontally lateral movement of the chair assembly along the transfer assembly frame, and a top section, the top section having a seat that is rotationally engaged with the base section to allow rotational movement of the seat with respect to the transfer assembly frame.

2. A portable shower chair and bathtub transfer assembly as recited in claim 1 wherein the transfer assembly frame does not extend beyond a plane formed by the outer walls of the bathtub.

3. A portable shower chair and bathtub transfer assembly as recited in claim 1 further comprising tightening means adaptable to exert force against the bathtub inner wall through the at least one appendage and the bathroom wall through the abutment portion thereby locking the transfer assembly frame in a fixed position with respect to the bathtub.

4. A portable shower chair and bathtub transfer assembly as recited in claim 3 wherein the transfer assembly frame does not extend beyond a plane formed by the outer walls of the bathtub.

5. A portable shower chair and bathtub transfer assembly as recited in claim 3 wherein the rotational engagement of the base section and the top section comprises bearing means.

6. A portable shower chair and bathtub transfer assembly as recited in claim 3 wherein the chair assembly further comprises a lateral locking means to lock the slidably engaged section at a desired location with respect to the transfer assembly frame.

7. A portable shower chair and bathtub transfer assembly as recited in claim 3 wherein the chair assembly further comprises rotational locking means to lock the rotationally engaged seat section at a desired location with respect to the base section.

8. A portable shower chair and bathtub transfer assembly as recited in claim 3 wherein the at least one appendage is pivotally mounted to the transfer assembly frame so that the appendage can be folded to a substantially flat position with respect to the transfer assembly frame to encourage portability.

9. A portable shower chair and bathtub transfer assembly for fitting into a standard bathtub having inner walls and the bathtub mounted against a bathroom wall, the portable shower chair and bathtub transfer assembly comprising:

a transfer assembly frame comprising parallel track surfaces and an abutment portion, the abutment portion adapted to rest against the bathroom wall, and the transfer assembly frame adapted to rest on top of the bathtub walls;

a first swing arm pivotally mounted to the transfer assembly frame having a folded position that is substantially flat with respect to the transfer assembly frame and having an extended position that is substantially perpendicular to the transfer assembly frame, the first swing arm in the extended position further comprising an extended end having suction cup means adapted for attachment to the bathtub inner wall opposite the bathroom wall;

a second swing arm pivotally mounted to the transfer assembly frame having a folded position that is substantially flat with respect to the transfer assembly frame and having an extended position that is substantially perpendicular to the transfer assembly frame, the second swing arm in the extended position further comprising an extended end having suction cup means adapted for attachment to the bathtub inner wall nearest the bathroom wall;

tightening means adaptable to exert force against the bathtub inner wall through the first swing arm and the bathroom wall through the abutment portion thereby locking the transfer assembly frame in a fixed position with respect to the bathtub; and a chair assembly comprising a base section, the base section slidably engaged along the parallel track surfaces to allow lateral movement of the chair assembly along the transfer assembly frame, and a top section, the top section having a seat that is rotationally engaged with the base section to allow rotational movement of the seat with respect to the transfer assembly frame.

10. A potable shower chair and bathtub transfer assembly for fitting into a standard bathtub having two opposed inner walls, the portable shower chair and bathtub transfer assembly comprising:

a transfer assembly frame comprising parallel track surfaces, the transfer assembly frame adapted to rest on top of the bathtub walls;

a first swing arm pivotally mounted to the transfer assembly frame having a folded position that is substantially flat with respect to the transfer assembly frame and having an extended position that is substantially perpendicular to the transfer assembly frame, the first swing arm in the extended position further comprising an extended end having suction cup means adapted for attachment to a bathtub inner wall;

a second swing arm pivotally mounted to the transfer assembly frame having a folded position that is substantially flat with respect to the transfer assembly frame and having an extended position that is substantially perpendicular to the transfer assembly frame, the second swing arm in the extended position further comprising an extended end having suction cup means adapted for attachment to the opposite bathtub inner wall;

tightening means adaptable to exert force between the bathtub inner walls through the first and second swing arms thereby locking the transfer assembly frame in a fixed position with respect to the bathtub; and a chair assembly comprising a base section, the base section slidably engaged along the parallel track surfaces to allow lateral movement of the chair assembly along the transfer assembly frame, and a top section, the top section having a seat that is rotationally engaged with the base section to allow rotational movement of the seat with respect to the transfer assembly frame.

11. A portable shower chair and bathtub transfer assembly for fitting into a standard bathtub having inner walls and the bathtub mounted against a bathroom wall, the portable shower chair and bathtub transfer assembly comprising:

a transfer assembly frame comprising parallel tubular members spaced apart and each tubular member having an end adapted to rest against the bathroom wall, and the tubular members each adapted to rest on top of the bathtub walls;

a first swing arm pivotally mounted to the transfer assembly frame having a folded position that is substantially flat with respect to the transfer assembly frame and having an extended position that is substantially perpendicular to the transfer assembly frame, the first swing arm in the extended position further comprising an extended end having suction cup means adapted for attachment to the bathtub inner wall opposite the bathroom wall;

a second swing arm pivotally mounted to the transfer assembly frame having a folded position that is substantially flat with respect to the transfer assembly frame and having an extended position that is substantially perpendicular to the transfer assembly frame, the second swing arm in the extended position further comprising an extended end having suction cup means adapted for attachment to the bathtub inner wall nearest the bathroom wall;

tightening means adaptable to exert force against the bathtub inner wall through the first swing arm and the bathroom wall through the tubular member ends thereby locking the transfer assembly frame in a fixed position with respect to the bathtub; and a chair assembly comprising a base section, the base section slidably engaged along the parallel tubular members to allow lateral movement of the chair assembly along the transfer assembly frame and a top section, the top section having a seat that is rotationally engaged with the base section to allow rotational movement of the seat with respect to the transfer assembly frame.

12. A portable shower chair and bathtub transfer assembly for fitting into a standard bathtub having two opposed inner walls, the portable shower chair and bathtub transfer assembly comprising:

a transfer assembly frame comprising parallel tubular members spaced apart, the tubular members adapted to rest on top of the bathtub walls;

a first swing arm pivotally mounted to the transfer assembly frame having a folded position that is substantially flat with respect to the transfer assembly frame and having an extended position that is substantially perpendicular to the transfer assembly frame, the first swing arm in the extended position further comprising an extended end having suction cup means adapted for attachment to a bathtub inner wall;

a second swing arm pivotally mounted to the transfer assembly frame having a folded position that is substantially flat with respect to the transfer assembly frame and having an extended position that is substantially perpendicular to the transfer assembly frame, the second swing arm in the extended position further comprising an extended end having suction cup means adapted for attachment to the opposite bathtub inner wall;

tightening means adaptable to exert force between the bathtub inner walls through the first and second swing arms thereby locking the transfer assembly frame in a fixed position with respect to the bathtub; and a chair assembly comprising a base section, the base section slidably engaged along the parallel tubular members to allow lateral movement of the chair assembly along the transfer assembly frame and a top section, the top section having a seat that is rotationally engaged with the base section to allow rotational movement of the seat with respect to the transfer assembly frame.

13. A portable shower chair and bathtub transfer assembly for fitting into a standard bathtub having inner walls and the bathtub mounted against a bathroom wall, the portable shower chair and bathtub transfer assembly comprising:

a transfer assembly frame comprising at least one track surface and an abutment portion, the abutment portion adapted to rest against the bathroom wall, and the transfer assembly frame adapted to rest on top of the bathtub walls;

at least one appendage attached to the transfer assembly frame, the at least one appendage adapted to extend downwardly along the bathtub inner wall opposite the bathroom wall and having suction means adapted for attachment to the inner wall of the bathtub opposite the bathroom wall; and a chair assembly comprising a base section, the base section slidably engaged along the at least one track surface to allow lateral movement of the chair assembly along the transfer assembly frame, and a top section, the top section having a seat that is rotationally engaged with the base section to allow rotational movement of the seat with respect to the transfer assembly frame.

14. A portable shower chair and bathtub transfer assembly for fitting into a standard bathtub having inner walls and the bathtub mounted against a bathroom wall, the portable shower chair and bathtub transfer assembly comprising:

a transfer assembly frame comprising at least one track surface and an abutment portion, the abutment portion adapted to rest against the bathroom wall, and the transfer assembly frame adapted to rest on top of the bathtub walls;

at least one appendage attached to the transfer assembly frame, the appendage adapted to extend downwardly along the bathtub inner wall opposite the bathroom wall;

tightening means adaptable to exert force against the bathtub inner wall through the at least one appendage and the bathroom wall through the abutment portion thereby locking the transfer assembly frame in a fixed position with respect to the bathtub; and a chair assembly comprising a base section, the base section slidably engaged along the at least one track surface to allow lateral movement of the chair assembly along the transfer assembly frame, and a top section, the top section comprising a seat having a rotational engagement with the base section to allow rotational movement of the seat with respect to the transfer assembly frame, the rotational engagement comprising bearing means, the bearing means comprising:

a circular bearing raceway formed by an upper section and a lower section, the upper and lower sections so machined that the upper and lower sections are locked together when the raceway is full of bearings;

a plurality of bearings;

a bearing loading channel to allow the placement of the bearings into the raceway; and a plug capable of insertion into the bearing loading channel to retain the loaded bearings in the circular raceway.

15. A portable shower chair and bathtub transfer assembly for fitting into a standard bathtub having inner walls and the bathtub mounted against a bathroom wall, the portable shower chair and bathtub transfer assembly comprising:

a transfer assembly frame comprising at least one track surface and an abutment portion, the abutment portion adapted to rest against the bathroom wall, and the transfer assembly frame adapted to rest on top of the bathtub walls;

at least one appendage attached to the transfer assembly frame, the appendage adapted to extend downwardly along the bathtub inner wall opposite the bathroom wall;

tightening means adaptable to exert force against the bathtub inner wall through the at least one appendage and the bathroom wall through the abutment portion, thereby locking the transfer assembly frame in a fixed position with respect to the bathtub; and a chair assembly comprising a base section, the base section having a slidable engagement along the at least one track surface to allow lateral movement of the chair assembly along the transfer assembly frame, the slidable engagement comprising roller means attached to the base section configured for rolling on the at least one track surface, the chair assembly further comprising a top section, the top section having a seat that is rotationally engaged with the base section to allow rotational movement of the seat with respect to the transfer assembly frame.

16. A portable shower chair and bathtub transfer assembly for fitting into a standard bathtub having inner walls and the bathtub mounted against a bathroom wall, the portable shower chair and bathtub transfer assembly comprising:

a transfer assembly frame having at least one track surface comprising spaced-apart parallel tubular members, the transfer assembly frame further having an abutment portion adapted to rest against the bathroom wall, and the transfer assembly frame adapted to rest on top of the bathtub walls;

at least one appendage attached to the transfer assembly frame, the appendage adapted to extend downwardly along the bathtub inner wall opposite the bathroom wall;

tightening means adaptable to exert force against the bathtub inner wall through the at least one appendage and the bathroom wall through the abutment portion, thereby locking the transfer assembly frame in a fixed position with respect to the bathtub; and a chair assembly comprising a base section, the base section slidably engaged along the at least one track surface to allow lateral movement of the chair assembly along the transfer assembly frame, and a top section, the top section having a seat that is rotationally engaged with the base section to allow rotational movement of the seat with respect to the transfer assembly frame.

17. A portable shower chair and bathtub transfer assembly for fitting into a standard bathtub having inner walls and the bathtub mounted against a bathroom wall, the portable shower chair and bathtub transfer assembly comprising:

a transfer assembly frame comprising at least one track surface and an abutment portion, the abutment portion adapted to rest against the bathroom wall, and the transfer assembly frame adapted to rest on top of the bathtub walls;

at least one appendage attached to the transfer assembly frame, the at least one appendage adapted to extend downwardly along the bathtub inner wall opposite the bathroom wall, and the at least one appendage having suction cup means adapted to attach the appendage against the bathtub inner wall;

tightening means adaptable to exert force against the bathtub inner wall through the at least one appendage and the bathroom wall through the abutment portion, thereby locking the transfer assembly frame in a fixed position with respect to the bathtub; and a chair assembly comprising a base section, the base section slidably engaged along the at least one track surface to allow lateral movement of the chair assembly along the transfer assembly frame, and a top section, the top section having a seat that is rotationally engaged with the base section to allow rotational movement of the seat with respect to the transfer assembly frame.

18. A portable shower chair and bathtub transfer assembly for fitting into a standard bathtub having inner walls and the bathtub mounted against a bathroom wall, the portable shower chair and bathtub transfer assembly comprising:

a transfer assembly frame comprising at least one track surface and an abutment portion, the abutment portion adapted to rest against the bathroom wall, and the transfer assembly frame adapted to rest on top of the bathtub walls;

at least one appendage attached to the transfer assembly frame, the appendage adapted to extend downwardly along the bathtub inner wall opposite the bathroom wall;

a chair assembly comprising a base section, the base section slidably engaged along the at least one track surface to allow lateral movement of the chair assembly along the transfer assembly frame, and a top section, the top section having a seat that is rotationally engaged with the base section to allow rotational movement of the seat with respect to the transfer assembly frame; and tightening means adaptable to exert force against the bathtub inner wall through the at least one appendage and the bathroom wall through the abutment portion, thereby locking the transfer assembly frame in a fixed position with respect to the bathtub, the tightening means comprising:

jackscrew means in the at least one appendage near a point of connection with the transfer assembly frame, the jackscrew means having a contact face adapted to be placed against the bathtub inner wall, and a handle for hand-operated tightening.

* * * * *

UNITED STATES PATENT AND TRADEMARK OFFICE

CERTIFICATE OF CORRECTION

PATENT NO. : 5,606,751

DATED : March 4, 1997

INVENTOR(S) : Robert E. Baker

It is certified that error appears in the above-identified patent and that said Letters Patent is hereby corrected as shown below:

Col. 1, line 67, "ambulator" should be --ambulatory--

Col. 2, line 27, "semipermanently" should be --semi-permanently--

Col. 2, line 58, "ambulator" should be --ambulatorily--

Col. 4, line 62, "foraged" should be --formed--

Col. 5, line 41, "drawing" should be --drawings--

Col. 6, line 56, "configurations" should be --configurations,--

Col. 6, line 57, "art" should be --art,--

Figure 1, the reference numeral "20" directed to the transfer assembly frame should be --24--

Col 6. lines 21, 27, 38, 40, 43, 54, 62, 65; Col. 7, lines 5, 8, 18, 20, 23, 48; Col. 8, lines 11, 14, 18, 44, 55, 60, 62, 65; Col. 9, lines 4, 66; Col. 10, lines 13, 16, 29, 35, 42, 49; and Col. 11, line 4, "20" should be --24--

Figure 5, the reference numeral "90" directed to the jackscrew face should be --91--

Col. 12, lines 13, 19, reference numeral "90" should be --91--

Col. 12, line 14, "carded" should be --carried--

UNITED STATES PATENT AND TRADEMARK OFFICE

CERTIFICATE OF CORRECTION

PATENT NO. : 5,606,751

DATED : March 4, 1997

INVENTOR(S) : Robert E. Baker

It is certified that error appears in the above-identified patent and that said Letters Patent hereby corrected as shown below:

Figure 6, the reference numeral "124" directed to the top section of the seat should be --120--

Col. 16, line 20, "fiat" should be --flat--

Signed and Sealed this

Ninth Day of December, 1997

*Attest:*

Bruce Lehman

BRUCE LEHMAN

*Attesting Officer*

*Commissioner of Patents and Trademarks*